US005220349A

United States Patent [19]

Saita et al.

[11] Patent Number: 5,220,349

[45] Date of Patent: Jun. 15, 1993

[54] METHOD AND APPARATUS FOR THERMALLY RECORDING DATA UTILIZING METALLIC/NON-METALLIC PHASE TRANSITION IN A RECORDING MEDIUM

[75] Inventors: Yoshiaki Saita; Seiji Kuwahara; Yoshinori Sato, all of Tokyo, Japan

[73] Assignee: Seiko Instruments Inc., Japan

[21] Appl. No.: 599,058

[22] Filed: Oct. 17, 1990

[30] Foreign Application Priority Data

Oct. 17, 1989 [JP] Japan ..... 1-269767
Oct. 17, 1989 [JP] Japan ..... 1-269768
Oct. 17, 1989 [JP] Japan ..... 1-269770

[51] Int. Cl.[5] ..... B41J 2/375
[52] U.S. Cl. ..... 346/76 PH; 219/216
[58] Field of Search ..... 346/1.1, 76 PH; 219/216, 504, 505

[56] References Cited

U.S. PATENT DOCUMENTS 4,203,119 5/1980 Naguib et al. ..... 346/76 PH
4,277,145 7/1981 Hareng et al. ..... 350/351
4,679,056 7/1987 Kobayashi et al. ..... 346/76 PH

FOREIGN PATENT DOCUMENTS 61-035265 2/1986 Japan .
62-181162 8/1987 Japan .
2-034361 2/1990 Japan .
2-117854 5/1990 Japan .

OTHER PUBLICATIONS

Patent Abstracts of Japan, vol. 9, No. 123 (E-317) (1846), May 28, 1985.
Patent Abstracts of Japan, vol. 14, No. 186 (M-962) (4129), Apr. 16, 1990.
Patent Abstracts of Japan, vol. 14, No. 339 (M-1001) (4282), Jul. 23, 1990.
Patent Abstracts of Japan, vol. 10, No. 191 (M-495) (2247), Jul. 4, 1986.
Patent Abstracts of Japan, vol. 12, No. 27 (M-662) (2874), Jan. 27, 1988.

*Primary Examiner*—Benjamin R. Fuller
*Assistant Examiner*—N. Le
*Attorney, Agent, or Firm*—Bruce L. Adams; Van C. Wilks

[57] ABSTRACT

A method and apparatus are applicable to a thermal recording system which records data in a recording medium using a heat generated by applying a power to a resistor. According to the invention the resistor itself or a monitor, which is disposed in the path of electric current applied to the resistor, is made of a material having the metallic/non-metallic phase transition characteristics at predetermined temperature, whereby the resistor or the monitor can have a function to interrupt the electric current at the predetermined temperature so that the peak temperature of the resistor s controlled constantly regardless of the value or period of the applied voltage. Further, it achieves a uniform recording property and a stable continuous tone recording property by controlling the period for holding the peak temperature of the resistor.

29 Claims, 6 Drawing Sheets

FIG. 15
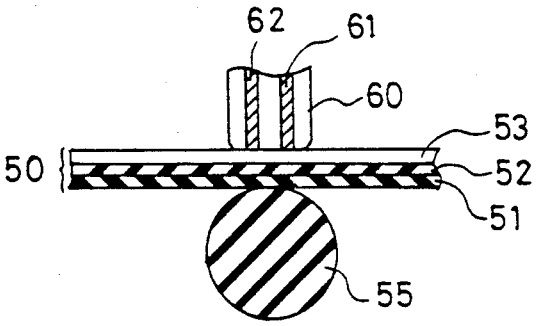
FIG. 17
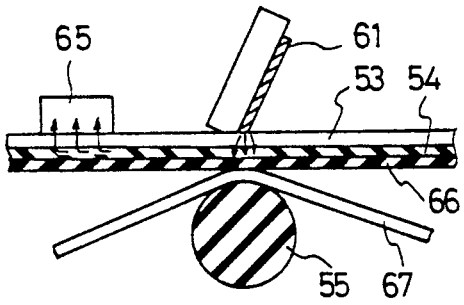
FIG. 16
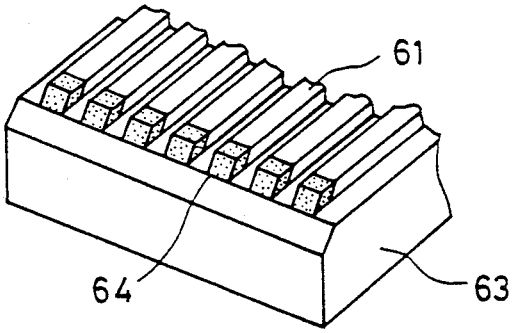
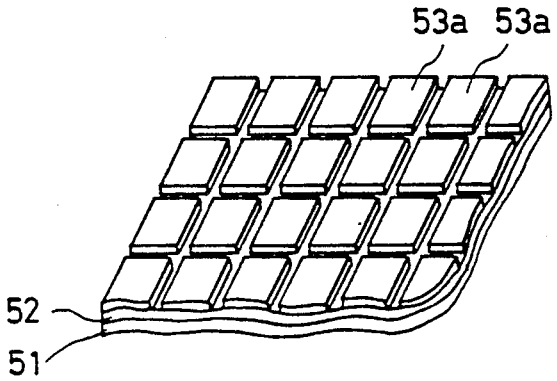
FIG. 18

METHOD AND APPARATUS FOR THERMALLY RECORDING DATA UTILIZING METALLIC/NON-METALLIC PHASE TRANSITION IN A RECORDING MEDIUM

BACKGROUND OF THE INVENTION

1. Field of the Invention

The present invention relates to a method and an apparatus for thermally recording information in a recording medium and, more particularly, for realizing an excellent recording by controlling the peak temperature of the heating resistors so that it does not exceed a specific temperature.

2. Description of the Prior Art

Conventional apparatuses for recording information in a recording medium thermally utilize a resistor of a metallic compound such as ruthenium oxide or tantalum nitride or a cermet resistor prepared by dispersing an insulator such as silicon oxide into a refractory metal such as tantalum in the heating resistor of the thermal head.

When a proper voltage is applied to the aforementioned heating resistor of the thermal head, an electric current flows through the heating resistor to generate heat energy in the form of Joule heat, and this state is maintained for a constant time to give to the heat-sensitive recording paper the thermal energy necessary for the recording. The energy of the Joule heat generated by the aforementioned heating resistor is determined in dependence upon the resistance of the heating resistor, the applied voltage and the time period for applying the voltage.

The conventional thermal recording apparatus so adjusts the applied voltage or the time period for applying the voltage according to the heat sensitivity of the heat-sensitive papers used, the background temperature around the heating resistor, the temperature of the recording medium itself and the thermal conductivity by which the thermal energy generated by the heating resistor is transmitted from the heating resistor to the heat-sensitive paper that it obtains the optimum recording quality and the desired recording density.

On the other hand, the powered transfer recording apparatus comprises an ink donor sheet having a power heating resistor layer which consists of carbon paint and a power supply head. When the power heating resistor layer is powered by the power supply head, the ink donor sheet is heated by the thermal energy generated by the power heating resistor layer so that the ink may be melted or sublimated and transferred to the recording medium. It so adjusts the applied voltage or the voltage applying time period according to the sheet resistance of the powered heating resistor layer, the temperature of the ink donor sheet and the electrode temperature of the power supply head that it makes the thermal energy generated by the powered heating resistor layer most suitable so as to obtain the optimum recording quality and the desired recording density.

In the thermal recording method of the prior art, for the following reasons, the adjustment of recording thermal energy according to the voltage and the pulse width to be applied to the heating resistor have serious shortcomings which to raise the production cost for the recording apparatus.

The thermal energy to be generated in the heating resistor by applying voltage pulses can be determined in dependence upon the voltage or the pulse width of the applied pulses, as has been described hereinbefore. Despite this fact, however, the temperature of the heating resistor will fluctuate with the pulse applying histories such as the period of applying the pulse and the number of the pulse applied continuously, the thermal histories of the heating resistor, or the temperature of the supporting substrate of the thermal head or the environments.

The thermal recording mechanism depends directly not upon the level of the thermal energy generated by the heating resistor but upon the temperature of the coloring layer of the heat-sensitive recording paper or the ink layer, i.e., the temperature of the heating resistor. If, therefore, it is desired to uniformize the temperature of the heating resistor at the heating time so as to achieve a uniform thermal recording to the heat-sensitive papers or the like, the apparatus needs to collect or predict the thermal data of the environment and histories in which the heating resistor is placed at the instant of heating. It has to so adjust and determine the voltage value or the pulse width of the applied voltage based on those data that the temperature of the heating resistor raises to the desired temperature.

The data collecting means, data predicting means and recording condition deciding means exert seriously high loads upon the hardwares such as a variety of temperature sensors for detecting the temperature of the thermal head substrate of the environment memories for storing the past recorded data so as to account for the recording histories, simulators such as a thermal equivalent circuit for predicting the thermal states, and the CPU and gate circuits for processing data. Seriously complex softwares are also required for supporting those hardwares. Especially, either a large-sized highly precise thermal recording apparatus having a plurality of heating resistors or an apparatus for recording data with a continuous tone of density has to process massive data so that it cannot avoid the increase in size and price while sacrificing the recording quality. On the other hand, the processing time for collecting and predicting the data and deciding the recording conditions is restricted by the CPU or the like and limits the high-speed recording.

Moreover, the thermal head is usually formed with a glazed layer as a heat insulating layer for enhancing the thermal efficiency. This glazed layer is formed by a thick film process so that its thickness disperses over ±20% of the average value of the thickness so that the heat insulating effect by the glazed layer randomly disperses among the individual thermal heads. No matter how accurately the data of the thermal environment of the heating resistor might be accumulated and processed to decide the individual recording condition, as has been described herein-before, the highly accurate exothermic temperature control would be blocked by the dispersion of the thermal characteristics of the thermal heads. If a more highly accurate control of the exothermic temperature is to be accomplished, the dispersion of the thermal characteristics of the individual-thermal heads also has to be incorporated as a control parameter so that the mass-productivity has to be seriously sacrificed by adjusting the recording apparatus one by one. If it is necessary to replace the thermal heads in the recording apparatus because of their troubles or lifetimes, it is almost difficult to adjust the settings of the recording apparatus for the individual characteristics of the thermal heads. The dispersions of the thermal capacity and the thermal resistance also depend upon the periphery of the heating resistor layer in the powered thermal recording, thus raising problems similar to those of the afore-mentioned case of the thermal head.

SUMMARY OF THE INVENTION

An object of the present invention is to provide an improved method and apparatus for uniformly controlling a temperature of a heating resistor of a thermal recording mechanism.

Another object of the present invention is to provide an improved method and apparatus for recording continuous tone data according to a period of time for holding a peak temperature of a heating resistor.

To realize the above and other objects, the present invention gives the thermal head itself a temperature self-control function to prevent the temperature of the heating resistor from exceeding a predetermined level.

More particularly, there is provided a monitor, which performs a temperature change equal or similar to that of the heating resistor in synchronism with both the temperature rise of the heating resistor when energized and the temperature drop of the heating resistor due to the interruption of the power-supply to the heating resistor, in the path in which the electric current flows to the heating resistor.

The monitor is made of a material of phase transition having its electric conductivity changed metallic at a lower temperature across a predetermined temperature range and non-metallic at a higher temperature. When the temperature of the heating resistor is raised to reach the predetermined temperature, i.e., the metallic/non-metallic phase transition temperature by applying the voltage to the heating resistor so as to generate the Joule heat, the phase transition material has its resistance increased substantially to that of an insulator or semiconductor to interrupt the current substantially. Therefore, the monitor suppresses the power so as to interrupt the temperature rise of the heating resistor when the temperature of the monitor rises to the predetermined temperature range, and it reestablishes the power again so as to rise the temperature of the heating resistor when lower than the predetermined temperature range. As a result, the temperature of the heating resistor is not raised to exceed the phase transition temperature so that its peak temperature can be uniformly controlled within the phase transition temperature range. By this uniform control of the peak temperature, the thermal recording can be uniformized. Further, by the control of a period of time for holding the peak temperature, it can achive a stable and excellently reproducible recording of continuous tone data.

Furthermore,, the heating resistor itself may be made of the material of phase transition.

DESCRIPTION OF THE DRAWINGS

FIGS. 4, 5, 6 and 11 are diagrammatic renditions of a burn point area of the thermal head of the present invention, showing various embodiments, in which FIGS. 4(A), 5, 6(A) and 11 are partially plan views of various embodiments and FIGS. 4(B) and 6(B) are partially sectional views of the thermal head shown in FIGS. 4(A) and 6(A);

FIGS. 15 and 17 are partially sectional views of apparatus for carrying the method of the present invention;

FIG. 16 is a partially perspective illustration of the thermal recording head to be used in the method of the present invention; and FIG. 18 is a partially perspective illustration of the power heating sheet to be used in the method of the present invention.

DESCRIPTION OF THE PREFERRED EMBODIMENTS

The invention will now be described with reference to the accompanying drawings representing embodiments thereof.

Figure 1:
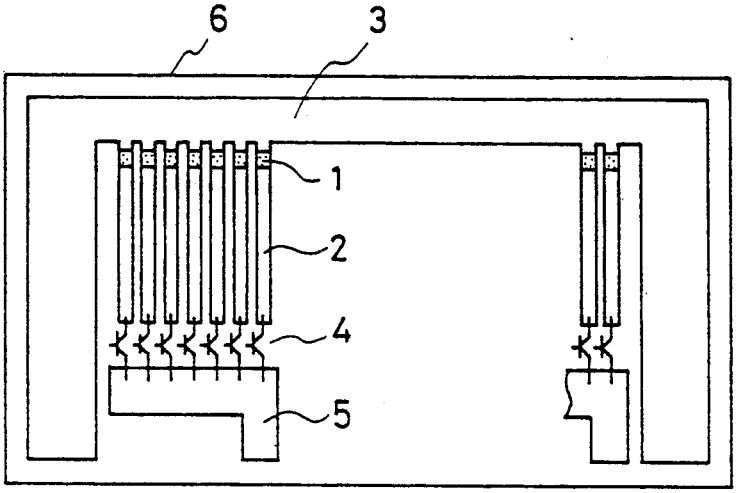
FIG. 1 is a plan view of an embodiment of a thermal head of the present invention.

FIG. 1 is a plan view of an embodiment of a thermal head of the present invention. This thermal head is constructed by forming thin-film heating resistors 1, which are made of a material having metallic characteristics of electric conductivity at a lower temperature up to about 300° C. and non-metallic characteristics at a higher temperature, such as vanadium oxide doped with about 0.1% of Cr to V, on a substrate 6 made of glazed alumina ceramics. The material of the heating resistors 1 has a metallic phase with relatively low resistance and relatively high conductivity in a temperature range below 300° C., undergoes phase transition in a temperature range whose lower boundary is 300° C., and has a non-metallic phase with relatively high resistance and relatively low conductivity at temperatures above the temperature range. The thermal head is formed by connecting one-side terminals of the heating resistors 1 with individual electrodes 2 and the other-side terminals with a first common electrode 3, and by connecting the individual electrodes 2 with current switching elements 4 such as transistors. Numeral 5 designates a second common electrode connected with the switching elements 4. The thermal head need not be equipped with the switching elements 4 and the second common electrode 5 which may be separately provide as the part of recording apparatus.

The first common electrode 3 is fed with a plus potential whereas the second common electrode 5 is fed with a minus potential, and voltage pulses are applied to the aforementioned heating resistors 1 by switching the switching elements 4. If the voltage pulses are applied to the heating resistors 1, a suitable power consumption is caused by the applied voltage and the resistances of the heating resistors 1, as in the thermal head in the thermal recording apparatus of the prior art, to generate the Joule heat so that the temperature rise of the heating resistors 1 is started.

Figure 2:
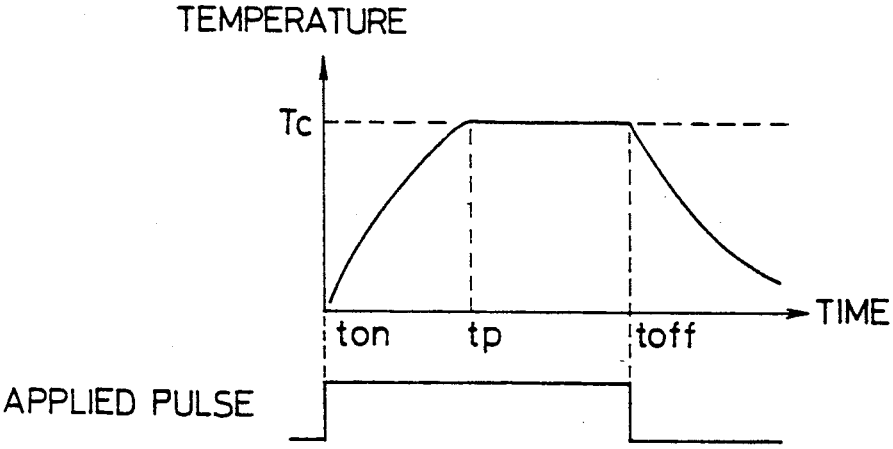
FIGS. 2 and 3 are graphical representations showing the heating temperature characteristics of the thermal head shown in FIG. 1.

FIG. 2 is a graphical representation showing the time changes of the surface temperature of the heating resistors 1 according to a pulse applied by the thermal head of FIG. 1. In FIG. 2, letter $T_c$ designates the temperature of the metallic/non-metallic phase transition at the electric conductivity of the heating resistors. Letter, $t_{on}$ designates the time to start applying the pulses. Letter $t_p$ designates the time at which the surface temperature of the heating resistors reaches the above-specified phase transition temperature ($T_c$). Letter $t_{off}$ designates the time to end the pulse applying. For the period between the time $t_p$ and the time $t_{off}$, the heating resistors 1 repeat the metallic/non-metallic phase transitions from the higher to lower temperatures and vice versa so that their surface temperature calms down or stabilizes in the vicinity of the aforementioned phase transition temperature $T_C$. The actual temperature of the heating resistor may be raised to a slightly higher level than the level $T_C$ by either the heat capacity of the structural member in the periphery of the heating resistors themselves or the thermal inertia due to the thermal resistance. The surface temperature of the heating resistors reaches the level $T_C$ of about 300° C. for a time period as short as about 0.5 secs from the time $t_{on}$ unless a heat absorber such as a heat-sensitive paper is brought into contact with the heating resistors, in case the heating resistors 1 have an area of 0.015 $mm^2$ corresponding to the heating resistor density of 8 dots/mm, in case the heating resistors 1 have a resistance of about 1,000 Ω at the lower temperature, and in case the applied voltage is 20 V. This time period is individually different for the structures of the thermal heads because the thermal characteristics such as the thermal resistance or heat capacity of the vicinity of the heating resistors are different in dependence upon the glazing thickness of the glazed substrate 6 of the thermal head or the thickness of the protecting layer coating the surfaces of the heating resistors 1. Since, however, the peak temperature of the heating resistors 1 is determined by the aforementioned phase-transition temperature $T_C$ of the material making the heating resistors, it does not depend upon the aforementioned thermal characteristics of the thermal head or the structure of the thermal head.

Further, the dispersion of the thermal characteristics, which the thermal head has, appears as the temperature rising gradient from the time $t_{on}$ to the time $t_p$, i.e., at the time $t_p$.

In the direct heat-sensitive recording system, the color developing mechanism is the chemical reaction of a coloring agent due to the heat and the reaction rate depends upon the temperature. In the thermal transfer recording system, the recording mechanism is the physical phase change such as the melting or sublimation of the ink and is dominated by the temperature of the ink. Therefore, the effect of the dispersion of the thermal characteristics on the recording characteristics is far smaller than those of the prior art in which the peak temperature of the heating resistor fluctuates.

On the other hand, the dispersion of the resistance of the heating resistors may exist in not only the thermal head in the thermal recording apparatus of the prior art but also the thermal head in the thermal recording apparatus of the present invention in dependence upon the thickness of the resistive films. However, this dispersion appears only as that of the period from the time $t_{on}$ to the time $t_p$ in the thermal head in the present invention so that the peak temperature of the heating resistor is unvaried. If it is intended to strictly reduce the dispersion of the temperature rising gradient, i.e., the dispersion of the time $t_p$ due to the resistance dispersion of the heating, resistors, the applied voltage may be adjusted and set to uniformize the electric power according to the magnitude of the resistance of the heating resistors in the metallic electric conductivity phase of the heating resistors at the lower temperature.

As has been described hereinbefore, the effect of the thermal characteristic dispersion and resistance dispersion of the thermal head upon the recording characteristics are remarkably small in the case of the thermal head in the present invention. For a larger applied pulse width, i.e., the longer time period from the time $t_{on}$ to the time $t_{off}$ of FIG. 2, as compared with the temperature rising period from the time $t_{on}$ to the time $t_p$, the changing and dispersing rates of the holding time period ($t_{off}-t_p$) of the peak temperature, which is the most contributable to the recording characteristics, are reduced even more to improve the recording quality the better.

In the embodiment described above, the temperature for the metallic/non-metallic phase transition of the heating resistors is set at about 300° C. In the case of a thermal head required for a higher recording speed, however, the heating resistors have a higher phase transition temperature of 400° to 450° C. so that their resistance may be lowered (or the applied voltage may be raised) to increase the electric power. Then, at a higher temperature rising rate and at a higher peak temperature, the coloring reaction of the heat-sensitive paper is sufficiently effected for a shorter time so that the peak temperature holding time can be retained for a shorter applied pulse width ($t_{off}-t_{on}$) to ensure a uniform recording operation. In a thermal head of lower speed and power consumption type, on the contrary, the power consumption rate in the heating resistors may be reduced by dropping the applied voltage (or by increasing the resistance of the heating resistors), or the aforementioned phase transition temperature may be dropped to about 250° C. Alternatively, these two methods may be combined.

FIGS. 4(A) and 4(B) are a partially plan view and a partially sectional view of modified thermal head.

The thermal head disposes a monitor 8 between the heating resistor 7 and the individual electrode 2. The heating resistor 7 is made of ordinary resistive material such as tantalum nitride. The monitor 8 is made of the material having the metallic/non-metallic phase transition used in the heating resistor shown in FIG. 1 and is set to have a lower linear resistance than that of the heating resistor 7. Therefore, when the power is applied between the common electrode 3 and the individual electrode 2, the heat contributable to the recording is generated mainly in the heating resistor 7 and the monitor 8 generates a far lower heat than that of the heating resistor 7. If the material used to make the monitor 8 could form a film having a lower sheet resistance such as several tens mm Ω than that of the heating resistor 7, the individual electrode 2 could also be made of the material of the metallic/non-metallic phase transition without discriminating it from the monitor 8.

When the voltage is applied to the heating resistor 7, the heating resistor 7 is heated by the Joule heat and the temperature of the monitor 8 is raised by the heat generated at the heating resistor 7. If the metallic/non-metallic phase transition temperature of the monitor 8 is 200° C., the electric current flows till the temperature of the monitor 8 reaches 200° C. When the temperature of the monitor 8 reaches 200° C., the current is substantially blocked by the non-metallic electric conductivity of the monitor 8 so as to interrupt the generation of the Joule heat. When the temperature of the monitor 8 is below 200° C., the current flows again to cause the heat generation of the heating resistor 7. Thus, the temperature of the monitor 8 is held at the temperature of 200° C. while the voltage is being applied. Therefore, the temperature of the heating resistor 7 is substantially constant at a higher temperature than at least that of the monitor 8 so that the surface temperature of the heating resistor 7 cannot exceed the constant level but is controlled. The accuracy of the temperature control of the heating resistor 7 is higher if the monitor 8 is closer to the heating resistor 7, and the monitor 8 may be disposed in the burn area of the heating resistor 7.

Figure 5:
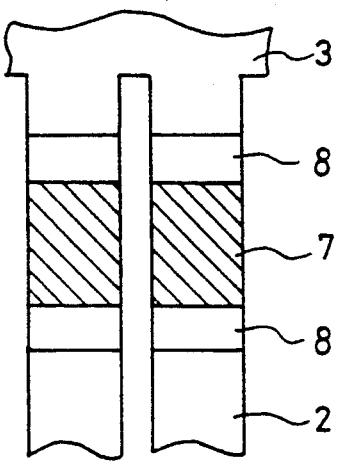

FIG. 5 shows a burn point area of the modified thermal head of the present invention.

The thermal head has monitors 8 made of the material having the metallic/non-metallic, phase transition disposed at the two sides of the heating resistor 7 which is made of ordinary resistive material such as tantalum nitride.

In the case of the embodiments thus far described, the wiring line 8 is disposed in contact with one side of the heating resistor 7 but may be disposed at the two sides thereof, as shown in FIG. 5. In case the electric conductivity of the material of the metallic/non-metallic phase transition used in the monitor 8 is not so small that an electric current will leak even at a higher temperature to raise the temperature of the heating resistor continuously, or in case the monitor 8 is heated by the leakage current at the higher temperature, it is preferable from the stand-point of the temperature control that the monitors 8 are disposed at the two sides of the heating resistor 7, as shown in FIG. 5, to enhance the current blocking ability.

Figure 6:
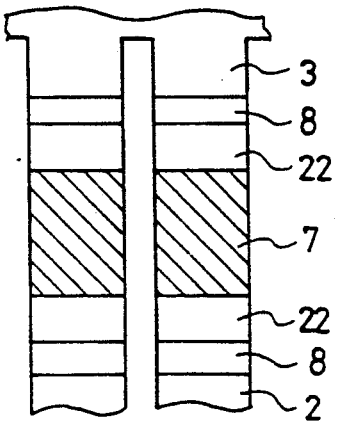
Figure 6:
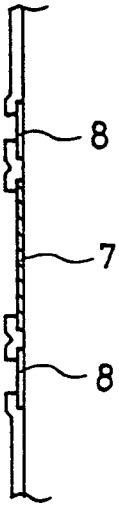

FIGS. 6(A) and 6(B) show a burn point area of a modified thermal head of the present invention.

This thermal head has electrodes 22 disposed between the heating resistor 7 and the monitors 8 in the thermal head shown in FIG. 5 and the behavior of the monitor 8 by the heating of the heating resistor 7 is not changed.

Especially in case the materials of the heating resistor 7 and the monitor 8 may possibly change their characteristics as a result of chemical reactions at a high temperature, it is more effective because the electrode 22 may be made of a stable metal such as gold in combination with at least the material of the monitor 8 to separate the monitor 8 from the heating resistor 7.

Figure 3:
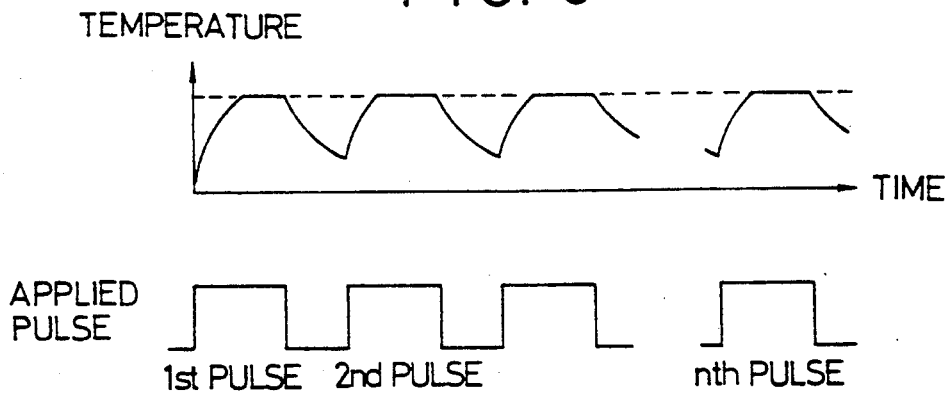

FIG. 3 shows the behaviors of the surface temperature changes of the heating resistor when the aforementioned thermal heads are driven with continuous pulses.

The peak temperature is constant for the time period from the first pulse to the n-th pulse, and the temperature rising time of the first pulse is longer due to the lower initial background temperature of the heating resistors, but the heating curves are substantially identical on and after the second pulse. Thus, the self-control can be made to provide a constant heating temperature without any driving control. The large length of the heating temperature-rising time by the first pulse raises no special problem even in the sublimation type continuous tone printer. In case a strict recording density management is necessary, the applied pulse width may be elongated the more for the temperature-rising time only in the case of the first pulse, i.e., the background temperature is low, to control the peak temperature holding time uniform.

In the recording apparatus for the continuous tone recording, it is customary to control the continuous tone according to the width of the applied pulses no matter whether the recording might be of the direct heat-sensitive type or the sublimation transfer type. In the thermal head of the prior art, the continuous tone control is difficult due to the fluctuations of the peak temperature of the heating resistors because the peak temperature will change together with the pulse width.

Figure 13:
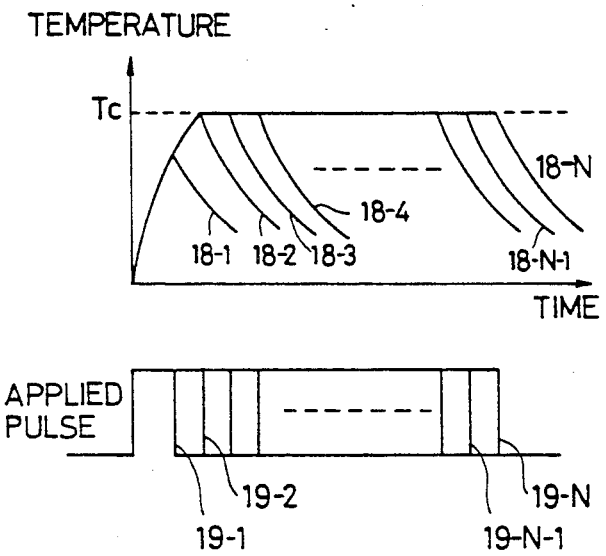
FIG. 13 is a graphical representation showing the continuous tone heating temperature characteristics or the thermal head of the present invention.

In the thermal head of the present invention, on the contrary, the peak temperature is self-controlled to a constant level so that the continuous tone can be more finely controlled with the parameter of time only, independently of the peak temperature. In the example of the prior art, some relative density control performs sixty four continuous tones, but the absolute density control is restricted to sixteen continuous tones at most. In the thermal head of the present invention, however, the absolute density control can be facilitated to one hundred and twenty eight continuous tones or two hundred and fifty six continuous tones, as has been apparent from the description thus far made. FIG. 13 is a diagram showing the waveforms of the surface temperature of the heating resistor with respect to the pulse width applied to the heating resistor, in case the thermal head of the present invention is utilized in the continuous tone recording. A heating resistor temperature waveform (18-1) by the first gradation pulse (19-1) starts its cooling drop midway of the temperature rise. Even with this gradation pulse setting, the continuous tone accuracy is high if the heating peak by pulses almost to the N-th continuous tone is within the time range controlling the peak temperature flat.

The aforementioned embodiments are embodiments controlling uniformly the temperature generated by the heating resistor of the thermal head to apply the heat on the recording medium such as the heat-sensitive recording paper or the ink donor sheet in the direct heat-sensitive recording system or the thermal transfer recording system.

In the powered thermal recording system in which the heat-sensitive recording paper or the ink donor sheet having a heat resistive layer itself is heated by applying the power on the heat resistive layer, too, the heating temperature of the heat resistive layer is uniformized by making the heat resistive layer of the material having the metallic/non-metallic phase transition so that it can record uniformly. The present invention embodied in the powered thermal recording system will be described in the following in connection with the embodiments thereof.

FIG. 15 shows a powered thermal recording device of the present invention.

A head 60 has a pair of electrodes 61, 62. A powered heat-sensitive recording sheet 50 is composed of a base sheet 52 such as a plastic sheet, a coloring recording layer 51 disposed on one surface of the base sheet 52 and a heat resistive layer 53 disposed on another surface of the base sheet 52. The coloring recording layer 51 is made of compounds of coloring agent and binder. The heat resistive layer 53 is made of the material having the metallic/non-metallic phase transition. The powered heat-sensitive recording sheet 50 is sandwiched between a platen 55 and the head 60 and is carried by rotating the platen 55. When voltage pulses are applied between electrodes 61, 62, the electric current flows from the portion of the heat resistive layer 53 coming in contact with the electrode 61 to the portion of the heat resistive layer 53 coming in contact with the electrode 62 so that the heat is generated in the aforementioned area of the heat resistive layer 53. The heat is transmitted to the coloring recording layer 51 through the base sheet 52 so that the area of the coloring recording layer 51 corresponding to the heated area of the heat resistive layer 53 generates color with the chemical reaction of the coloring agent due to the heat.

FIG. 17 shows a powered thermal transfer recording device of the present invention. An ink donor sheet is composed of a base sheet 54 made of metal having lower conductivity than that of the heat resistive layer 53, the heat resistive layer 53 being disposed on one surface of the base sheet 54 and an ink layer 66 being disposed on another surface of the base sheet 54. The ink layer 66 is made of the thermal melting ink. The ink donor sheet and a recording paper 67 are sandwiched between a platen 55 and a head having an electrode 61 and are carried by rotating the platen 55. Further, an electrode 65 is disposed in contact with the heat resistive layer 53. When voltage pulses are applied between electrodes 61, 65, the electric current flows from the electrode 61 to the electrode 65 through the heat resistive layer 53 and the base sheet 54. The electric current flows mainly in the depth direction in the heat resistive layer 53 because the base sheet 54 has lower conductivity than that of the heat resistive layer 53. Therefore, the portion of the heat resistive layer 53 being in contact with the electrode 61 generates the heat. The heat is transmitted to the ink layer 66 through the base sheet 54 so that the portion of the ink layer 66 corresponding to the electrode 61 is melted by the heat and the melted ink is transferred to the recording paper 67.

In the devices shown in FIGS. 15 and 17, the peak temperature of the heat resistive layer 53 is always constant independently of the applied voltage, the power apply time, the sheet resistance of the heat resistive layer 53, the temperature of the head, and the temperature of the platen 55 and the environment because the heat resistive layer 53 is made of the material having the metallic/non-metallic phase transition.

FIG. 16 shows a modified head for applying the power in the powered thermal recording system. A head is composed of a supporting substrate 63, the electrodes 61 disposed on the supporting substrate 63 for applying the power, and portions 64 disposed at each pointed end of the electrodes 61. Each portion 64 is made of the material having the metallic/non-metallic phase transition and has a function to interrupt the electric current based on its temperature and makes contact with the powered recording medium having the heat resistive layer. When the applied voltage pulse is applied to the heat resistive layer of the powered recording medium by the head, the heat resistive layer generates the heat. The temperature of the portion 64 rises, accompanying the temperature rise of the heat resistive layer of the recording medium. If the temperature of the portion 64 reaches the phase transition temperature of the material having the metallic/non-metallic phase transition, the portion 64 changes to non-metallic phase and interrupts the electric current. As a result, the head can control the peak temperature of the heat resistive layer to a constant level. In this case, the heat resistive layer can be made of conventional material such as tantalum nitride.

Here, the aforementioned material having the metallic/non-metallic phase transition is exemplified by a compound of vanadium oxide. This vanadium oxide will change the metallic/non-metallic electric conductivity, if doped with a minute amount of Cr, in a region at a higher temperature than the room temperature. The doped vanadium oxide has a non-metallic electric conductivity at a higher temperature and a metallic electric conductivity at a lower temperature. Both vanadium and its oxide are refractory materials and can be used to make the heating resistors. The heating resistor film can be formed by the thin-film process such as the sputtering or by the thick-film process of spreading either a paste, which is prepared by powdering the material and mixing it with a binder, or an organic metal. In either case, the filmed vanadium oxide component is required to have at least a polycrystalline structure. The sputtering process is exemplified either by sputtering an alloy target of metallic vanadium and chromium or a metallic vanadium target having buried chromium with a mixture gas of argon and oxygen, or by high-frequency sputtering a target, which is sintered of vanadium oxide powder and chromium oxide power, with argon gases or a mixture gas of argon and minute oxygen. In either sputtering method, the temperature to be filmed is desirably at several hundreds ° C. or higher so as to crystalize surely.

In the case of doping of a proper amount of Cr, the electric conductivity will change by 2 to 3 orders at the aforementioned phase transition temperature. If, therefore, the material is used to make the heating resistor of the thermal head and the heat resistive layer of the heat-sensitive papers, the power to be consumed around the aforementioned phase transition temperature in the state of constant voltage application changes by 2 to 3 orders and it follows from this that it takes hold of the heating state and non-heating state substantially from the thermal recording standpoint. The phase transition temperature can be changed according to the ratio of the doping Cr so that the peak temperature of the heating resistors can be set. Further, the phase transition temperature shifts to the lower temperature side as the ratio of the doping Cr increases. The vanadium oxide having no dopant of Cr has a resistance that changes at a small rate and gently with change of temperature. Since, however, the resistance rises by one order from the lower to higher temperatures across about 400° C., the undoped vanadium oxide can also be used in the thermal head of the present invention.

Figure 14:
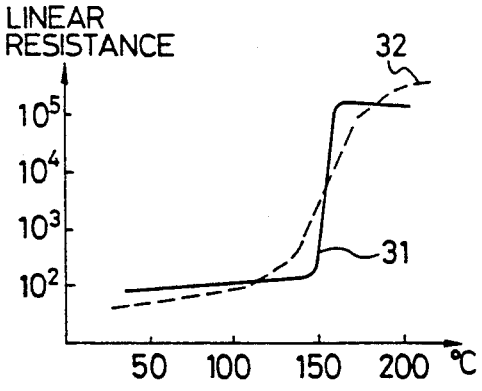
FIG. 14 graphical representation showing the temperature dependency of the linear resistance of the material exhibiting the metallic/non-metallic phase transition.

FIG. 14 is a diagram showing the temperature changes of the linear resistance film which constitutes of the heating resistor exhibiting the metallic/non-metallic phase transition. The resistance of the linear resistance film can be changed by changing the film thickness and the line width. In this example, the vanadium oxide doped with about 0.5% of Cr has a metallic phase in a lower temperature range under about 150° C. and has a non-metallic phase in a higher temperature range over about 150° C., and the resistance at 200° C. is approximately three order of magnitude ($10^3$) larger than the resistance at 100° C., as indicated by a linear resistance characteristic curve 31. The temperature range for causing the resistance change with the dopant Cr is so changed with the increase of the dopant Cr that it is gradually shifted to the lower temperature side. If the doping ratio of Cr to V of the vanadium oxide exceeds several percentages, the change of increasing the resistance from the lower to higher temperatures disappears so that the object of the present invention cannot be achieved. Since the doping ratio of Cr changes the temperature characteristics of the resistance change, as has been described hereinbefore, the change of the linear resistance may be made gentle to have a certain temperature width, as indicated by a curve 32 in FIG. 14, by the monhomogeneity of Cr doped in the vanadium oxide even if the doping ratio of Cr to V of the vanadium oxide is 0.5%. With this gentle change, the object of the present invention can be achieved. When a heating resistor having a side of several mm below 1 , for example, is to be energized and heated, its resistance change appears gentle, as indicated by the curve 32 of FIG. 14, in case the above-specified material is used to make the heating resistor of the thermal head, because the temperature rise is not spatially uniform in the heating resistor. In this case, too, the temperature rise and the energization stop are caused in a micro manner so that the heating resistor can realize the temperature rise or not without any problem.

Further, the material having the metallic/non-metallic phase transition characteristic may be a mixed crystal, represented by $Ba_xPb_{1-x}TiO_3$, composed of barium titanate and lead titanate. In this case, it has the phase transition temperature of about 300° C. and the electric conductivity changes by 2 to 3 orders at the phase transition temperature when x is equal to 0.55.

Next, another driving method of the thermal head or the power supply head in the thermal recording method of the present invention will be described in connection with another embodiment thereof.

Figure 7:
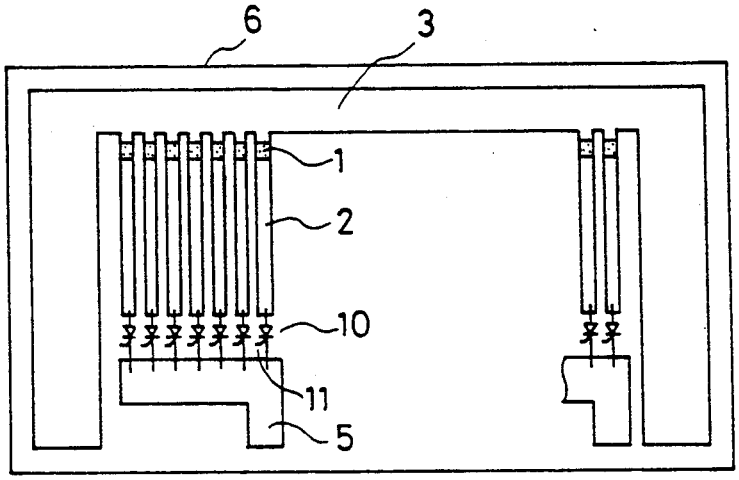
FIG. 7 is a plan view of an alternate embodiment of the thermal head of the present invention.

FIG. 7 is a top plan view showing the thermal head in which the switching element of the aforementioned thermal head of FIG. 1 is made of a thyristor. The thyristors 10, which are connected at 1:1 with the individual heating resistors 1 having the metallic/non-metallic phase transition characteristics, are turned on by inputting a turn-on signal to their gates 11 at an arbitrary timing according to the recorded data. The first common electrode 3 is fed with a plus potential , and the second common electrode 5 is fed with a minus potential. When the thyristors 10 are turned on, the heating resistors 1 are substantially fed with the difference between the plus and minus potential so that they start to pass the electric currents. Upon this energization, the heating resistors 1 generate, the Joule, heat energy so that their temperature rises are started. When the temperature of the heating resistors 1 reach the metallic/non-metallic phase transition temperature of the material making the heating resistors, the value of the current flowing through the heating resistors drops by 2 to 3 orders if the heating resistors are made of vanadium oxide doped with Cr, for example. If elements having suitable turn-off characteristics are selected as the thyristors 10, these thyristors 10 are turned off by interrupting the current through the heating resistors 1. Once the thyristors 10 are turned off, the heating resistors 1 cannot be energized again so long as the turn-on signal is not inputted to the gate 11, so that the heating resistors 1 interrupt their heat generations. In other words, the heating resistors 1 automatically interrupt their heat generations, when they are energized to have their temperature reaching the aforementioned phase transition level, and are cooled down to stand-by for the subsequent input of the thyristor turn-on signal.

Figure 8:
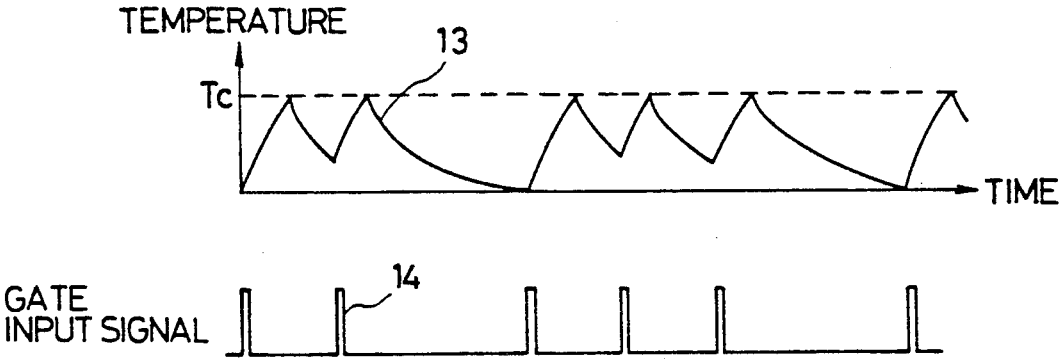
FIG. 8 is a graphical representation showing the heating temperature characteristics of the thermal head shown in FIG. 7.

FIG. 8 is a diagram showing the time changes of the surface temperature of the heating resistors in case the heating resistors 1 of the thermal head shown in FIG. 7 are continuously driven by the aforementioned thyristors 10. Numeral 13 indicates the surface temperature of the heating resistors, and numeral 14 indicates the gate input signal of the thyristors 10, i.e., the timing signal for starting the heating. Letter Tc designates the aforementioned phase transition temperature. No matter what timing gate input pulses 14 might be inputted, as is apparent from FIG. 8, the surface temperature of the heating resistors would not exceed the level Tc, but the temperature rising and dropping curve in the vicinity of the peak temperature, which belongs to the most important temperature for the thermal recording, is identical for either heat generation.

In the foregoing description of the temperature rising and dropping curve, it has been described that the curve is not influenced by the heating history of a specific one of the heating resistors. However, the rising and dropping curves of the peak temperature of the specific heating resistor 1 are not influenced to realize the uniform heat generation at all times even for the simultaneous heat generations, the histories of the past heat generations of the heating resistors adjacent to or around the specific heating resistor or the temperature of the substrate 6 of the thermal head. Moreover, even if the applied power dispersion accompanying the dispersion of the resistances of the heating resistors and the thermal characteristic dispersion accompanying the dispersion of the glazed layer thickness exists between either the individual heating resistors or the individual thermal heads, the peak temperature to be determined by the aforementioned phase transition temperature and the heating, waveforms in the vicinity of the peak temperature are uniformized.

Figure 12:
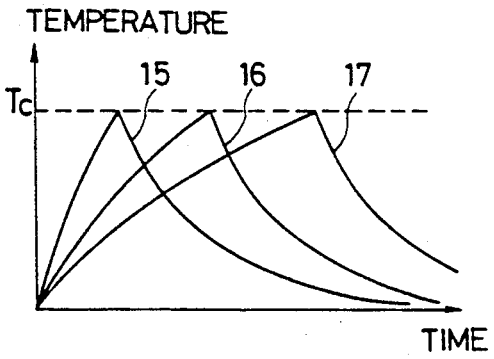
FIG. 12 a graphical representation showing the heating temperature characteristics of the thermal head of the present invention.

In the case of the thermal head having the combination of the aforementioned material for the metallic/non-metallic phase transition and the thyristor, the peak temperature of the heating resistor is always constant. As a result, under the identical thermal driving conditions, the recording density will be different in case the coloring sensitivity is different due to the difference of the kinds of the heat-sensitive paper. As shown in FIG. 12, the surface temperature of the heating resistors changes with the voltage applied to the heating resistors, as indicated by temperature rising curves (15, 16 and 17). In case the heat-sensitive paper of standard sensitivity is used, for example, the aforementioned applied voltages are so set as to follow the rising curve 16 of the heating resistor surface temperature. In the case of the heat-sensitive paper of low sensitivity, the applied voltage is set by lowering the applied voltage to elongate the temperature maintaining time of the vicinity of the peak temperature, as indicated by the curve 17. In the case of the heat-sensitive paper of high sensitivity, on the contrary, the applied voltage is raised to reach the peak temperature instantly, as indicated by the curve 15. In this manner, the thermal head can correspond to the difference in the recording sensitivity characteristics of the heat-sensitive paper by solely changing the applied voltage.

Another effective method for coping with the sensitivity difference is also exemplified by a preheat of the heat-sensitive paper or the ink donor sheet immediately before heating of the heating resistor. In the case of low heat-sensitive paper, for example, no change in the voltage applied to the heating resistor can be sufficient if the aforementioned preheating temperature is set at a high level.

The thyristor can be utilized in switching the power applied to the head 60 in the powered thermal recording device shown in FIG. 15. In this case, a circuitous current path is left, so that an extreme current reduction cannot be obtained, even if a minute, portion corresponding to one picture element turns nonconductive, because the heat resistive layer 53 is widely planar. It is, therefore, necessary to provide a circuit having a large turn-off current. Further, it can reduce the circuitous path current, can ensure the current blocking property of the heat resistive layer 53 and can achieve the fine recording property by which the heat resistive layer 53 is divided into a plurality of islands 53*a* having a similar size to the recording picture element, as shown in perspective view in FIG. 18.

Figure 9:
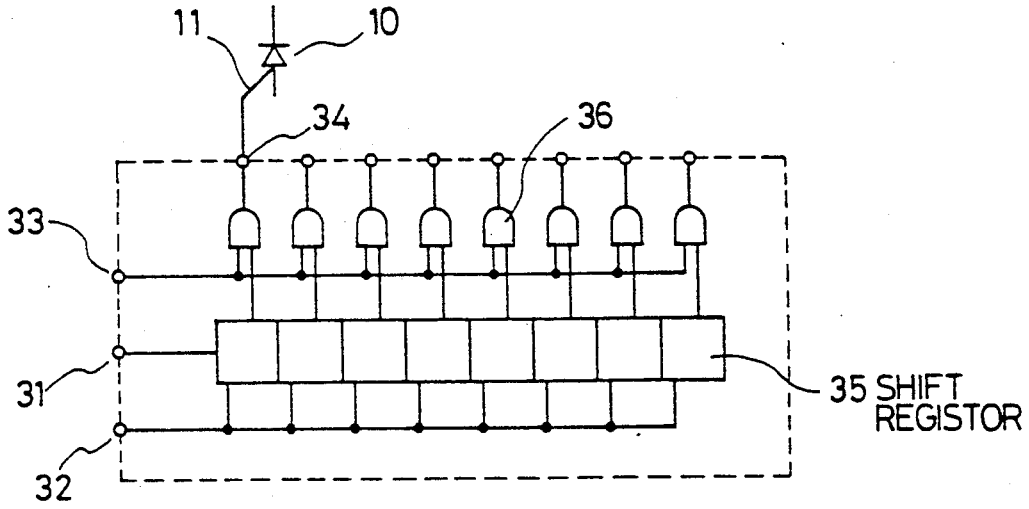
FIG. 9 is a block diagram of an embodiment of a driving control circuit for carrying out the method of the present invention.
Figure 10:
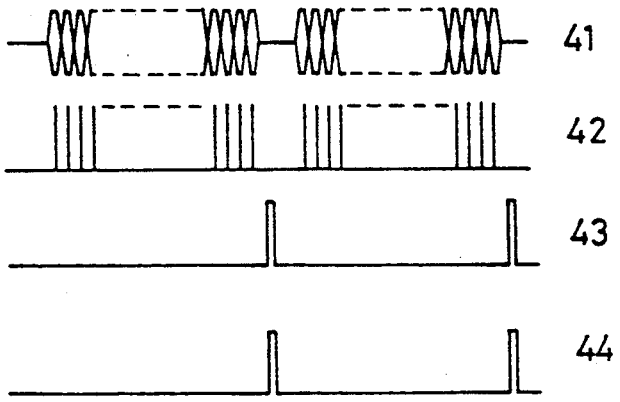
FIG. 10 timing chart showing control timing of the driving control circuit shown in FIG. 9.

FIG. 9 shows one embodiment of the heating drive control circuit, and FIG. 10 is a driving timing chart of the thermal head using the drive control circuit. In FIG. 9, reference numeral 35 designates serial-in parallel-out shift registers having a serial input terminal 31 and a shift clock terminal 32, and numeral 36 designates an AND gate which is fed with the parallel outputs of the shift registers 35 and the heating timing signal coming from an input terminal 33 and which has an output terminal 34. This output terminal 34 of the AND gate 36 is connected with the gate 11 of a thyristor 10, which in turn is connected with the heating resistor, so that it can turn on the thyristor 10 selectively. In FIG. 10, numeral 41 designates video data of one recording line, and numeral 42 designates a shift clock. If the video data 41 are arrayed in the aforementioned shift registers 35, a heating timing signal 43 is inputted in the form of pulses of several microsecs so that the input signal 44 of the gate 11 of the thyristor 10 is outputted in the form of pulses of several microsecs from the aforementioned output terminal 34 in accordance with the content of the video data 41. When the input signal 44 is outputted, the drive control circuit shown in FIG. 9 can be released from the heating operation and shifted to a series of the aforementioned preparations for the next line.

The drive control circuit of the conventional thermal head is enabled to perform the high-speed processing by having a latch circuit so that the recording video data may be written in parallel with the heating operations of the heating resistors. However, in the present invention, the high-speed parallel processing can be accomplished without the latch circuit by combining the heating resistors of the metallic/non-metallic transition and the thyristors. As a result, it is possible not only to reduce the size and drop the cost of the drive control circuit but also to reduce the size of the thermal head packaging the drive control circuit.

In all the embodiments excepting the aforementioned powered recording one, the peak temperature of the heating resistors is unvaried no matter whether the recording medium such as the heat-sensitive papers acting as an endothermic source might contact with the heating resistors or not. As a result, the thermal head of the present invention is freed from the deterioration or breakage of the heating resistors due to an abnormal rise of the peak temperature, which might otherwise be caused in the state of no paper feed of the heating resistors of the thermal head of the prior art. Moreover, a high reliability is exhibited even in the event of malfunction or runaway of the drive control circuit or CPU due to noises.

This effect is commonly applied to the powered thermal recording by enhancing the reliability and safety of the apparatus with neither the abnormal heat generation or firing of the powered heat-sensitive recording paper due to the runaway of the circuit nor the breakage of the parts as the platen.

Figure 4:
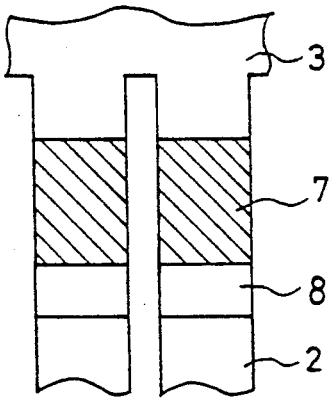
Figure 4:
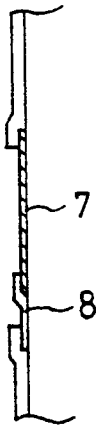
Figure 11:
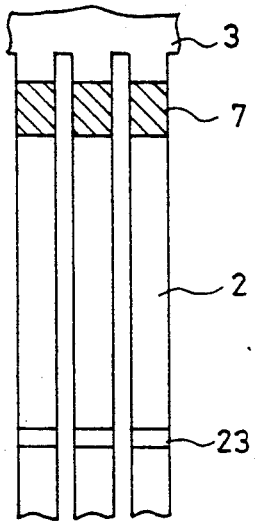

FIG. 11 is a top plan view showing an essential portion of the thermal head, in which the heating simulator 23 made of the material of the metallic/non-metallic phase transition is arranged in series with the individual electrode 2 at a position apart from the heating resistor 7 made similar to that of FIG. 4. The aforementioned heating simulator 23 is given a linear resistance lower than that of the heating resistor 7 and higher than the individual electrode 2. If the heating resistor 7 is energized to generate the heat, the heating simulator 23 starts a gentle heat generation. If the temperature of the metallic/non-metallic phase transition of the heating simulator 23 is set at about 120° C., for example, the heating simulator 23 is heated by the Joule heat to about 120° C. simultaneously with the temperature rise of the heating resistor 7 so that it is transferred to the non-metallic phase. As a result, the current flowing through the individual electrode 2 connected in series with the heating simulator 23 and the heating resistor 7 can be blocked like the aforementioned individual embodiments to realize the heating control of the heating resistor 7. The heating and cooling behaviors of the heating simulator 23 are substantially similar to those of the aforementioned heating resistor 7 but are highly different in the peak temperature. The heating simulator 23 is not directly influenced by the temperature changes due to the voltage pulse applied to the heating resistor 7 because it is positioned a distance apart from the heating resistor 7. The heating simulator 23 is most seriously influenced by the background temperature resulting from the flow heat storage or rise of the thermal head substrate due to the heat storage around the exothermic simulator itself, the environmental temperature or the heat generation of the heating resistor. As a result, the heat generation by the heating resistor cannot be completely controlled, but a sensitive reaction is exhibited for the fluctuations of the apparent coloring sensitivity due to the temperature fluctuations of the heat-sensitive papers accompanying the fluctuations of the environmental temperature and the inside temperature of the recording apparatus. As to the influences of the heating resistors around or adjacent to a heating resistor being noted, the peripheral heating simulators thermally interfere with one another to effect the heating simulations of the grouped heating resistors, if the heating simulators 23 are aligned with one another like the positional relationship of the heating resistors 7, as shown in FIG. 11. Since, moreover, the heating simulator is not heated to a high temperature but has a small thermal impact, it is advantageous in the heat-resisting reliability for the material of the metallic/non-metallic phase transition. If a protecting layer over the heating resistor is likewise formed over the heating simulator, the reliabilities are improved against oxidation or thermal degradation of the heating simulator and against the impact of the crystalline structural change accompanying the aforementioned phase transfer.

Incidentally, in all the embodiments thus far described, the characteristics of the material used in the heating resistor, the heat resistive layer, the leading end of the power supply electrode, the wiring line and the heating simulator need not have the electric conductivity changed discontinuously at the predetermined temperature but may have the conductivity changed continuously within a temperature range having a predetermined width. In order to ensure the exhibition of the effects of the present invention, the electric conductivity is at least 1 order and desirably 2 orders or more. This necessary change means the practically minimum changing ratios of both the low resistance, which is invited by the power consumption (or energy) to enable the heating temperature rise to reach a level necessary for the recording, and the high resistance by which the power consumption (or energy) becomes lower than the level for maintaining the temperature of at least the heating resistor or the heat resistive layer at the temperature level relating the recording under the condition of a constant applied voltage. In short, in order to implement the actions of the present invention, it is important to make use of the material which has its electric conductivity changed at the aforementioned minimum ratio in dependence upon the temperature.

According to the present invention, as has been described hereinbefore, the following excellent effects can be exhibited:

(1) The peak temperature of the heating resistor can be uniformly controlled for all the temperature environments in which the heating resistor of the thermal head or the heat resistive layer of the powered heat-sensitive recording sheet is placed;

(2) The dispersion of the recording characteristics can be suppressed for the thermal characteristic dispersion such as the glazed layer of the thermal head;

(3) The recording characteristic dispersion can also be suppressed for the dispersion of the sheet resistance of the heat resistive layer;

(4) The highly precise density gradation control is facilitated;

(5) The heating drive control circuit can be simply constructed to reduce the sizes of the circuit, the thermal head and the power supply head substrate;

(6) The recording can be speeded up with ease;

(7) The temperature data collection circuit or the recording density correction circuit, such as the temperature detections of the recording apparatus, need not be used so that the apparatus can be provided with a small size and at a reasonable cost; and (8) A high reliability and safety can be obtained against the runaway of the heating resistor.

What is claimed is:

1. An apparatus for thermally recording data in a recording medium using electrically-generated heat, comprising:

heating means for generating heat in response to electric voltage supplied thereto, the heating means being made of a material having a metallic/non-metallic phase transition within a temperature range which includes a predetermined temperature high enough for thermal recording and having a resistance which changes greatly around the predetermined temperature;

a constant voltage power source for supplying electric power to the heating means to cause electric current to flow therethrough; and wherein the resistance of the heating means has metallic characteristics until the temperature of the heating means rises to the predetermined temperature and the resistance of the heating means is low during that period, and when the heating means is supplied with electric power and generates enough heat for the temperature to rise to the predetermined temperature, the resistance of the heating means rises rapidly and substantially and comes to have non-metallic characteristics whereby the electric current flowing through the heating means itself is rapidly reduced and a further rise in the temperature of the heating means is restrained.

2. An apparatus as claimed in claim 1; further including switching means, disposed in a path for supplying electric power to the heating means, for turning on and off the supply of electric power to the heating means whereby the switching mean initiates the flow of electric current through the heating means according to an external signal, rises the temperature of the heating means, and cuts off the electric current flowing through the heating means in response to the electric current which is rapidly and substantially reduced by the heating means itself when the temperature of the heating means reaches the predetermined temperature.

3. An apparatus for thermally recording data in a recording medium using electrically-generated heat, comprising:

heating means for generating that in response to electric voltage supplied thereto;

a constant voltage power source for supplying electric power to the heating means to cause electric current to flow therethrough; and monitor means, disposed in a path for supplying electric power to the heating means, for monitoring the temperature of the heating means by undergoing a temperature change equivalent or similar to a temperature change of the heating means by the heat generated by the monitor means itself, the monitor means being made of a material having a metallic/non-metallic phase transition at a predetermined temperature so that the monitor means reduces electric current flowing through the heating means when the temperature of the monitor means reaches a predetermined temperature range which includes said predetermined temperature, the predetermined temperature range of the monitor means being proportional to a temperature sufficient for the heating means to thermally record the data.

4. An apparatus as claimed in claim 3; further including switching means, disposed in the path, for turning on and off the supply of electric power to the heating means whereby the switching mean initiates the flow of electric current through the heating means according to an external signal, raises the temperature of the heating means, and cuts off the electric current flowing through the heating means in response to the electric current which is rapidly and substantially reduced by the heating means itself when the temperature of the heating means reaches the predetermined temperature.

5. A method for recording continuous tone data using a heating resistor which is made of a material having metallic/non-metallic phase transition within a temperature range which includes a predetermined temperature, generates heat when supplied with electric power, and maintains a peak temperature of the heating resistor at the predetermined temperature during the supply of electric power, comprising the steps of:

determining a period for maintaining the peak temperature of the heating resistor according to a tone of the continuous tone data; and applying a constant voltage pulse having a pulse width based on the determined period to the heating resistor.

6. A method for recording continuous tone data using a heating resistor which generates heat when supplied with electric power, and monitor means which is made of a material having metallic/non-metallic phase transition at a predetermined temperature, is disposed in a path for the supply of electric power to the heating resistor, undergoes a temperature change equivalent or similar to the temperature change of the heating resistors, and maintains a peak temperature of the heating resistor at a temperature corresponding to the predetermined temperature of the monitor means during the supply of electric power, comprising the steps of:

determining a period for maintaining the peak temperature of the heating resistor according to a tone of the continuous tone data; and applying a constant voltage pulse having a pulse width based on the determined period to the heating resistor.

7. A system for thermally recording data in a recording medium, comprising: heating means responsive to voltage applied thereto for generating heat energy to effect thermal recording and having a metallic phase with relatively low electrical resistance at temperatures within a first temperature range and having a non-metallic phase with relatively high electrical resistance at temperatures above a second temperature range which is higher than the first temperature range and exhibiting a metallic-to-non-metallic phase transition within a third temperature range between the first and second temperature ranges, the third temperature range including a temperature which is high enough to effect thermal recording; and means for applying constant voltage to the heating means to cause operation thereof alternately in the metallic and non-metallic phases to thereby stabilize the peak temperature of the heating means during thermal recording.

8. A system according to claim 7; wherein the heating means has an electrical resistance characteristic which changes abruptly, within the third temperature range, from the relatively low electrical resistance to the relatively high electrical resistance.

9. A system according to claim 7; wherein the heating means has an electrical resistance characteristic which changes gradually, within the third temperature range, from the relatively low electrical resistance to the relatively high electrical resistance.

10. A system according to claim 7; wherein the hating means is composed of a first material doped with a second material, the doping concentration of the second material determining a slope of a resistance-temperature curve within the third temperature range.

11. A system according to claim 10; wherein the first material comprises vanadium oxide.

12. A system according to claim 11; wherein the second material comprises chromium.

13. A system according to claim 10; wherein the second material comprises chromium.

14. A system according to claim 7; wherein the heating means is composed of a mixed crystal of barium titanate and lead titanate.

15. A system according to claim 7; wherein the relatively low and high electrical resistance values differ by at least two orders of magnitude.

16. A system according to claim 7; wherein the relatively low and high electrical resistance values differ by three orders of magnitude.

17. A system according to claim 7; wherein the third temperature range includes 250° C.

18. A system according to claim 7; wherein the third temperature range includes 300° C.

19. A system according to claim 7; wherein the third temperature range includes 400° C.

20. A system according to claim 7; wherein the third temperature range includes 450° C.

21. A system according to claim 7; wherein the heating means constitutes part of a recording medium in which data is to be thermally recorded.

22. A system according to claim 7; wherein the heating means constitutes part of a thermal head for thermally recording data in a recording medium.

23. A system for thermally recording data in a recording medium, comprising: heating means responsive to voltage applied thereto for generating heat energy to effect thermal recording, the generation of heat energy resulting in a change in the temperature of the heating means; means for applying constant voltage to the heating means to flow electric current therethrough to cause the heating means to generate heat energy; and monitoring means for monitoring the heat energy liberated by the heating means and controlling the current flow through the heating means to stabilize the peak temperature thereof, the monitoring means having a metallic phase with relatively low electrical resistance at temperatures within a first temperature range and having a non-metallic phase with relatively high electrical resistance at temperatures within a second temperature range which is higher than the first temperature range and exhibiting a metallic-to-non-metallic phase transition within a third temperature range between the first and second temperature ranges, the third temperature range being proportional to a temperature of the heating means sufficient to thermally record data, and the relatively high electrical resistance being high enough to substantially reduce the current flow to the heating means to thereby stabilize the peak temperature thereof.

24. A system according to claim 23; wherein the heating means and the monitoring means are mechanically connected to a common thermal head, the monitoring means being disposed immediately adjacent to the heating means.

25. A system according to claim 24; including two similar monitoring means disposed on opposite sides of and sandwiching therebetween the heating means.

26. A system according to claim 23; wherein the heating means and the monitoring means are mechanically connected to a common thermal head, the monitoring means being disposed adjacent to but separated from the heating means by an electrode which is composed of a material more chemically stable at high temperatures than one or both of the heating means and monitoring means.

27. A system according to claim 23; wherein the third temperature range includes 200° C.

28. A system according to claim 23; wherein the relatively low and high electrical resistance values differ by at least two orders of magnitude.

29. A system according to claim 23; wherein the relatively low and high electrical resistance values differ by three orders of magnitude.

* * * * *